United States Patent [19]

Lambert et al.

[11] Patent Number: 4,909,407

[45] Date of Patent: Mar. 20, 1990

[54] CAN LID WITH EASY-OPEN TAB

[76] Inventors: G. Steven Lambert, 1920 Cheremoya Ave., Los Angeles, Calif. 90008; Michael P. Lambert, 5959 Franklin Ave., Hollywood, Calif. 90028

[21] Appl. No.: 339,820

[22] Filed: Apr. 18, 1989

[51] Int. Cl.[4] ..... B65D 7/32

[52] U.S. Cl. ..... 220/268; 220/266; 413/15

[58] Field of Search ..... 220/266, 268, 269, 270, 220/90.6; 413/15, 16, 17

[56] References Cited

U.S. PATENT DOCUMENTS

| | | | |
|---|---|---|---|
| 3,171,580 | 3/1965 | Davis et al. | 220/90.2 |
| 3,760,752 | 9/1973 | Geiger | 413/15 |
| 3,819,083 | 6/1974 | Holk, Jr. | 220/90.6 |
| 3,880,316 | 4/1975 | Martella | 220/90.6 |
| 3,894,652 | 7/1975 | Brown | 220/90.6 |
| 3,997,076 | 12/1976 | Jordan | 220/268 |
| 4,215,792 | 8/1980 | Klein | 220/268 |
| 4,585,140 | 4/1986 | Lambert et al. | 220/268 |
| 4,723,684 | 2/1988 | Lambert et al. | 220/268 |

*Primary Examiner*—David T. Fidei

*Attorney, Agent, or Firm*—Nutter, McClennen & Fish

[57] ABSTRACT

A stamped and scored one-piece container lid with an integral push-in tear tab has a tab-defining score line formed with a bottom wall, an inclined first side wall and a second side wall opposite to the first side wall and which is upset onto the bottom wall and the lower portion of the first side wall forming a ring around the latter with the result that the tab is relatively easy to push in, but is able to withstand an appreciable outward force due to pressure inside the associated container.

7 Claims, 1 Drawing Sheet

CAN LID WITH EASY-OPEN TAB

BACKGROUND OF THE INVENTION

This invention relates to a can lid with a push-in tear tab. It relates more particularly to a one-piece lid having a tab which can be pushed down into the container to form a pour opening in the lid without separating from the lid.

FIELD OF THE INVENTION

The lids of the type wth which we are concerned are used to form the top walls of cans or other containers for a variety of different products such as beverages, powdered or granulated materials and the like which may be maintained in the container at or above atmospheric pressure. The invention is particularly applicable to lids for cans contaiiing carbonated beverages.

Container lids with integral tear tabs for forming pour openings in the lids are well known in the prior art. Until the last few years, the mos prevalent type of tear tab lid for beverage oontainers consisted of a two-piece construction having a finger-opeated pull ring riveted to a portion of the lid delineated by a tab-defining score line. When the user pulls the ring away from the can, the ring and tab separate from the remainder of the lid thereby forming a pour opening in the lid for hhe container contents. The torn out tab is a metallic curl with sharp edges and is often carelessly disposed of creating a visual nuisance and a safety hazard. Also, that two-piece lid is relatively expensive to make involving, as it does, the riveting of a pull ring to the lid per se.

In an effort to respond to the objections raised against the aforesaid containers with separable tear tabs, a container lid was designed with a leverage ring that, when lifted, pushes a scored, tab-defining area of the lid into the interior of the container to form a pour or drink opening, with both the tab and the leverage ring remaining attached to the lid. An example of this typeoof container lid is dislosed in U.S. Pat. No. 4,084,721 and the related references identified therein. While this lid solved the environmental problems associated with lids with separable tear tabs, it has not cut costs eecause it still requires the riveting of a separate leverage ring to the can lid.

It is only relatively recently that serious efforts have been made to develop a container lid with an integral tear tab scored into the lid which can be pushed in by the user's finger to form a drink or pour opening in the lid while remaining attached to th lid, examples of same being disclosed in U.S. Pat. Nos. 4,078,694 and 4,377,244.

In the most common form of push-tab lid construction, an opening is formed in the lid which is closed by an integral tab hinged to the lid, the scored joint between the tab and the reainder of the lid being sealed on the inside by a plastic sealant material. As these containers often contain a carbonated beverage, there is substantial internal pressure acting against the underside of the tab. Consequently, the tab is usually made larger than the opening in the lid so that its edge margin engages under the lid to prevent the tab from being puhhed out by the internal pressure. However, forming and sealing this larger tab requires multiple steps in the fabrication of the lid, and therefore increases the total cost of the can.

Usually also, to facilitate pushing in the tab, the lid includes a smaller vent hole closed by a similar integral tab which can be pushed in to relieve the internal pressure before the larger tab is depressed to open the pour opening in the lid. Even then, the consumer must push down with his finger with a considerable force on the pour tab which is about the same size as the end of the finger before that tab will separate along its score line from the remainder of the lid. Consequently, the exerting of the requisite opening force may be a problem for certain aged or infirm individuals. More importantly, when the consumer does succeed in pushing in the pour tab, that tab tends toggive way suddenly so that the consmer's finger often thrusts down into the pour opening where it can be cut by the sharp scored edgeof that opening.

Very recently, a lid has been developed whcch addresses the aforesaid easy-open and safety problems. This lid, disclosed in our U.S. Pat. No. 4,585,140, has a ridge located between the tear tab and the push location to protect the consumer's pushing finger and indentations at the opposite ends of the tab-defining score line which make it easier to depress the tab to produce a large effective pour opening. However, this lid construction has score line around the tear tab that may not always be able to withstand high gas pressures inside the container.

SUMMARY OF THE INVENTION

Accordingly, the present invention aims to provide an improved container lid with an integral push-in tear tab which can withstand relatively larg container internal pressures and yet i still easy to open.

Yet nother object is to provide such a push-in tear tab which can be fabricated from a single piece of material in a few simple steps.

A still further object is to provide an integral push-in tear tab which reduces the required tab push-in force and eliminates altogether the need for a separate venting hole in the lid, while retaining sufficient resistance to internal pressure to allow the packaging of most carbonated beverages.

Other objects will, in part, be obvious and will, in part, appear hereinafter.

The invention accordingly comprises the features of construction, combination of eleents and arrangement of parts which will be exemplified in the following detailed description, and the scope of the invention will be indicated in the claims.

Briefly, our invention is a one-piece can or container lid with an integral embossed and scored push-in tear tab. The tab is scored around an end adjacent to the rim of the lid so that it will tear along the score line upon the application of a downward force applied by the consumer's finger in the area of the tab.

Preferbly, but not necessarily, the tab delineated by the score line is more or less triangulr or nose-shaped. Desirably also, the container lid is stamped or embossed to form the raised ridge and depressions described in our aforementioned U.S. Pat. No. 4,585,140 for the reasons stated in that patent, the description in whch is incorporataed herein by reference.

The preferred embodiment of the invention is a single piece lid with a tear tab delineated from the rest of the lid by a score line which is cut only pattially through the lid. In cross section, the score line forms a valley in the lid material. This valley has a bottom wall and two side walls, namely, an inside wall, that being the one nearer the tab which forms the tab rim, and an outside wall, that being the one further away from the tab. The inside wall is inclined at a predetermined angle. It extends from the lowest point of the valley in a straight line to the upper surface of the lid. The outside wall consists of residual material that is pushed down or upset into the valley so as to overlap the bottom wall and the lower portion of the inclined inside wall.

To push the tab o open the container, the consumer only has to press down on the designed push area of the lid with enough force to fracture the small amount of lid materia between the bottom of the valley and the underside of the lid. Thus, even weak or infirm individuals can open a container fitted with a lid of this type. The residual material of the score line valley outside wall overlying the bottom wall and the lower portion of the inside wall of that valley forms a barrier or reinforcement with sufficient strength to prevent the tab from being pushed upward or outward by ga pressure inside the can.

While having the aforesaid advantages, the present container lid is still relatively inexpensive to make. Its tab may be fabricated in two simple scoring steps. Moreover, pressurized contents such as carbonated beverages may be packaged without the need to apply sealant material to the underside of the lid, or to resort to the multiple fabrication steps previuusly required to provide a tab which is larger than the tab opening. In addition, a second hole in the lid for venting the can does not have to be present. Since the fabrication of the lid is simplified, an attendant reduction in the cost of fabrication is realized.

BRIEF DESCRIPTION OF THE DRAWING

For a fuller understanding of the nature and objects of the invention, referecce should be had to the following detailed description, taken in connection with the accompanying drawing, in which.

BRIEF DESCRIPTION OF THE DRAWING

Figure 1:
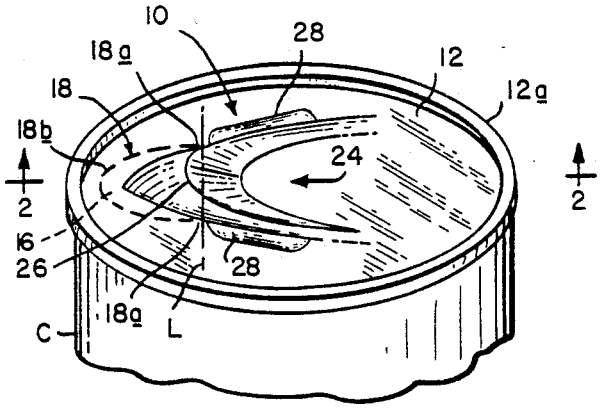
FIG. 1 is a fragmentary perspective view of a beverage can having a lid made in accordance wth this invention.
Figure 2:
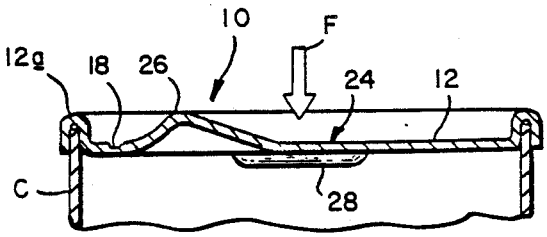
FIG. 2 is a sectoonal view taken along line 2—2 of FIG. 1.

Referring to FIGS. 1 and 2 of the drawing, a conventional container C such as a beverage can is closed at the top by a lid indicated generally at 10 embodying our invention. The lid 10 comprises a disk 12 usually made of aluminum or steel metal, although it could be composed of plastic material, which is pressed onto the upper edge of container C in a known manner by the use of a rolled edge 12*a*. A plastic sealant material (not shown) is usually present at the joint between the lid and container.

Lid 10 has in integral tear tab 16 which is delineated in disk 12 by a score or tear line 18. While the score or tear line 18 that demarks the tab 16 may have a variety of different shapes, it is usually in the form of an open loop with the ends 18*a* of the score line being located at spaced-apart locations on disk 12 which define a hypothetical or imaginary line L corresponding to a segment of a chord of disk 12. By the word "loop", we mean not only a single curved line, but also a line composed of a series of straight or curved line segments.

Preferably, the score line has a midportion 18*b* which extends relatively close to the rolled edge 12*a* of the lid so that, when the tab 16 is pushed in, it forms an opening in the lid which is relatively close to the lid edge so that the consumer can pour or drink the container contents readily through that opening. Thus, while lid 10 has a tab 16 which is more or less triangular in shape, the score line 18 could just as well define a tab which is circular oval or some other shape.

Figure 4:
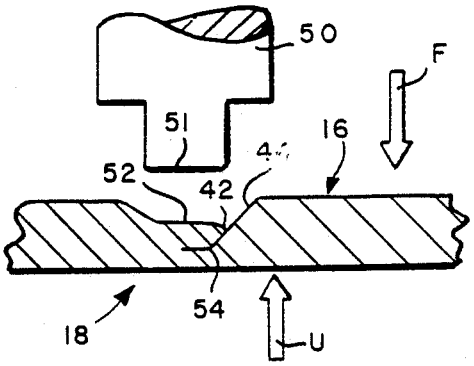
FIG. 4 is a similar view of the lid showing the finished score line and the final step in its formation.

As best seen in FIGS. 2 and 4, the score line 18 of the illustrated lid 10 is cut in the upper surface of disk 12 and extends most of the way through the disk 12 forming a valley as shown in FIG. 4. Although not necessary for correct operation of the tab 16, plastic sealant material (not shown) may be placed along the score line 18 at the underside of the lid to further nnsure a fluid-tight seal between the tab 16 and the remainder of the disk 12. Desirably also a raised ridge 26 is provided inboard of score line 18 and depressions 28 are formed at the ends of score line 18 for the reasons described in the aforementioned U.S. Pat. No. 4,585,140.

The consumer opens container C by applying a finger or thumb to a designated area 24 on the lid disk 12 and pushing down to apply a downforce F to area 24. In lid 10 shown in FIG. 1, the push area or pressure point 24 is located on the opposite side of line L from score line 18 and behind ridge 26. Therefore, when the consumer pushes in tab 16, the pushing digit is positioned away from the sharp torn edge of the lid opening which is exposed after the tab is pushed to its open position.

The pushing force F fractures the score line segment 18*b* first, thereby venting the container C. Thus, the container no longer has any internal pressure to resist the further depressing of tab 16. The downward force F applied to location 24 also suffices to fracture any sealant present along soore line 8. Thus, tab 16 tears away or separates from the remainder of disk 12 all along the score line from line segment 18*b* at the free end of tab 16 to the score line ends 18*a* at the root of the tab. Whereupon, the portions of disk 12 outboard of ridge 26 and behind line L flex or bend so that tab 16 is depressed below the nominal plane of disk 12, thereby forming a pour opening in lid 10.

Ridge 26 rigidifies tab 16 so that it does not curl or bend when pushed into the container and in that respect, it causes the tab to function differently from the remainder of the disk 12. That factor plus the presence of the depressions 28 causes the tab 16 to deflect downwardly further into container C, as described in our previous patent, forming a larger pour opening than would be the case in the absence of the depressions.

Figure 3:
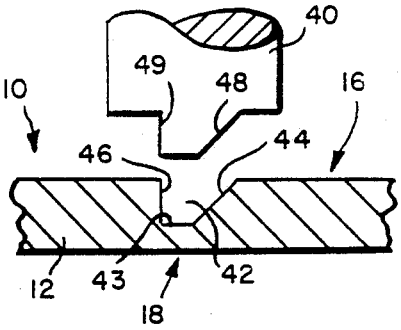
FIG. 3 is an enlarged sectional view of the lid showing the first step in the formation of its score line.

Refer now to FIG. 3 which shows in cross section a partially completed score line 18. As seen there, a aalley or groove 42 is formed by running an appropriately shape scoring tool 40 along the top surface of disk 12 along the intended score line 18 path. The valley 42 is defined by a bottom wall 43 and two side walls 44 and 46. One of these side walls, namely, the inner wall 44 closer to tear tab 16 is inclined. In other words, in cross section, this inside wall 44 is an inclined plane extending from the bottom wall 43 of the valley 42 up to the top surface of the disk 12, and inward towards tear tab 16. The angle of inclination of wall 44 is typically in the order of 40° to 50°, with 45° being the optimum angle. The outer wall 46 of valley 42 is more or less vertical. That is, in cross section, this outside wall 46 extends perpendicularly from the bottom wall 43 of valley 42 to the top surface of the lid 10.

The scoring tool 40 thus also has an inclined inside cutting or scoring surface 48 and a preferably vertical outside cutting or scoring surface 49 so that the appropriately shaped valley 42 is formed as scoring tool 40 is advanced along the top surface of disk 12.

FIG. 4 shows the completed score line 18 in cross section. The lid material adjacent to outside wall 46 is upset or collapsed into the valley 42 by moving a punch die 50 along the path of score line 18 adjacent to the outside wall 46. This operation results in the outside wall material being folded over or upset onto the bottom wall 43 and the lower portion of inside wall 44 forming a ledge or ring 52 of material arund wall 44. The die 50 preferably has a more or less flat bottom surface 51, but other tol shapes can be used to achieve the desired upsetting of the outside wall 46 material ino valley 42 as shown.

The forming of score line 18 as shown produces several beneficial results. The tab 16 is easy to open since the amount of downward force F necessary to open the tab 16 is only the force required to fracture the thickness of disk material between the valley bottom wall 43 and the btttom surface of the lid 10. This force F is thus completely determined by that thickness and the disk material itself. These variables are arranged so that the score line 18 fractures when the force F s in the range of 3 to 4 pounds per square inch.

While the tab 16 defined by score line 18 is easy to open, it also provides adequate resistance to an upward force U on tab 16 caused by the pressurized contents of the container C. In particular, the disk material from the collapsed valley outside wall 46 that forms the overlying ring 52 provides a reinforcement against upward or outward movement of the tab 16. In other words, that material provides a mechanical stop 54 that resists upward or outward movement of the inclined inside wall 44 constituting the rim of tab 16 that might cause tearing of the disk material at bottom wall 43. In effect, then, this score line 18 behaves like the ones in other lids discussed at the outset which define tabs that are larger than the pour opening. However, score line 18 is easier to form.

Still further, the use of score line 18 described herein avoids having to provide a separate vent tab in the lid. That is, when the oonsumer pushes down on the lid 10 with the requisite 3 to 4 pound force F, the disk material present at the score line segment **18*b*** readily fractures to vent the container and relieve the internal pressure so that the entire tab can be pushed easily into the container.

It will be seen from the foregoing, then, that our container lid with an integral push-in tear tab can be made relatively inexpensively by simple stamping and scoring operations. Moreover, the lid can be installed on a conventional container C in the customary way so that it does not add appreciably to the overall cost of the container. The lid can also withstand relatively high internal pressure. Yet it can be opened with a single pushing operation even by relatively weak or infirm individuals. For all these reasons, our container lid should find wide acceptance in the marketplace.

It will thus be seen that the objects set forth above, among those made apparent from the preceding description, are efficiently attained. Also, certain changes may be made in the above construction without departing from the scope of the invention. For example, the score line does not have to be formed in the lid of the container; it could be in the container wall. In fact, the invention has application wherever it is desired to form a tear line in a metal sheet. Therefore, it is intended that all matter contained in the above description or shown in the accompanying drawing be interpreted as illustrative and not in a limiting sense.

It is also to be understood that the following claims are intended to cover all of the generic and specific features of the ivention herein described.

What is claimed as new and desired to be secured by Letters Patent of the United States is:

1. A container lid having top and bottom surfaces and a tear tab area delineated from the rest of the lid by a score line extending partially through the lid, said score line comprising:

a bottom wall;

an inclined first wall extending from the top surface of the lid to said bottom wall; and a second wall opposite to and coextensive with said first wall, said second wall being upset into said score line so that it overlies and tightly engages said bottom wall and the lower portion of said first wall forming a ring around said first wall whereby said score line tears more readily in response to a force applied to the top surface of the lid in the tear tab area than it does in response to a similar force applied to the bottom surface of the lid in that same area.

2. The container lid defined in claim 1 wherein said fist wall is proximal to said tear tab area and said second wall lies outboard said first wall.

3. The container lid defined in claim 2 wherein said first wall is inclined toward said tear tab area.

4. A method of forming a tear tab in a lid having top and bottom surfaces comprising the steps of:

scoring the top surface of the lid to form a tear tab-delineating groove which has a bottom wall, an inclined first side wall and a second side wall opposite to and coextensive with said first side wall; and upsetting lid material from the second side wall into the groove so that the material overlies and engages the bottom wall and at least the lower portion of said first side wall forming a ring around said first side wall.

5. The method defined in claim 4 wherein the first side wall is formed proximal to the tear tab and the second side wall is formed outboard said first side wall.

6. The method defined in claim 5wherein the second side wall is formed to extend substantially perpendicular to said lid surfaces.

7. A tearable sheet structure having opposite surfaces formed by scoring one surface of the structure to form a tear-delineating groove which has a bottom wall, an inclined iirst side wall and a second wall opposite to and coextensive with the first side wall and then upsetting structure material from the second side wall into the groove so that hhe material overlies and engages the bottom wall and at least the lower portion of the first side wall thereby forming a ledge extending along the first side wall.

* * * * *